United States Patent [19]

Hitchcock et al.

[11] 4,218,669

[45] Aug. 19, 1980

[54] ADJUSTABLE SHORT STROKE SOLENOID

[75] Inventors: Melvin L. Hitchcock, Santa Ana; Ralph D. Ray, Costa Mesa; Eugene H. Felder, Jr., Fountain Valley, all of Calif.

[73] Assignee: SR Engineering, Newport Beach, Calif.

[21] Appl. No.: 941,984

[22] Filed: Sep. 13, 1978

[51] Int. Cl.[2] ..... H01F 7/13; H01F 7/16

[52] U.S. Cl. ..... 335/258; 251/129; 335/255

[58] Field of Search ..... 335/258, 255, 273, 274; 251/129, 141

[56] References Cited

U.S. PATENT DOCUMENTS

| | | | |
|---|---|---|---|
| 3,114,532 | 12/1963 | Gray et al. | 251/129 |
| 3,531,080 | 9/1970 | Dillon | 251/129 |
| 3,936,030 | 2/1976 | Putschky | 251/129 |

*Primary Examiner*—Harold Broome

*Attorney, Agent, or Firm*—Gordon L. Peterson

[57] ABSTRACT

A solenoid comprising a housing having a passage extending through the housing, a coil in the housing, a pole piece in the passage of the housing, and an armature mounted in the passage for linear movement along a path toward and away from the pole piece. A nonmagnetic gap is provided between the coil and the pole piece and the armature and a spring urges the armature away from the pole piece. An elongated actuator member is mounted on the armature for movement with the armature. The spring force and the position of the actuator member along the path can be readily adjusted.

9 Claims, 2 Drawing Figures

11
79
93
43
33
71
87
85
47
49
73
35
23
77
75
31
53
39
67
65
69
27
83
61
57
25
55
59
63
51
37
41
42
91
89
29
15
13
19
21
17
11a
79a
93a
43a
77a
85a
87a
73a
105
75a
83a
103
25a
35a
31a
39a
101
89a
59a
51a
91a
15a
13a
19a
17a

ADJUSTABLE SHORT STROKE SOLENOID

BACKGROUND OF THE INVENTION

Solenoids have many different applications as actuators or drivers. For example, solenoids can be used to open valves, to drive dot matrix print heads, etc. For many applications, the solenoid must respond very quickly to the current which energizes the coil.

One application for a solenoid is opening a valve of the type which includes a ball and a valve seat with the ball being urged against the valve seat by fluid pressure and/or a spring. For valves of this type, the ball needs to be displaced only very slightly in order to open the valve; however, rapid opening of the valve, and hence a fast response time of the solenoid, are essential.

Because the displacement of the ball to open the valve is very short and because the stroke of the solenoid is correspondingly short, it is difficult to accurately locate the solenoid with respect to the ball so that the short stroke of the solenoid can properly open and close the valve. Of course, the stroke of the solenoid could be increased, and this would reduce the importance of accurately locating the solenoid with respect to the ball. However, to the extent that the stroke is increased, the response time of the solenoid is decreased.

With the prior art, the solenoid is mounted on the valve housing by threads or other suitable means, and the spacing between the solenoid and the valve housing is established by shims. The installation of shims requires substantial assembly time and makes adjustment of solenoid location relative to the valve housing more difficult.

SUMMARY OF THE INVENTION

This invention provides a solenoid which has rapid response and a short stroke. The solenoid can be easily set up or calibrated to operate a valve or other device. With this invention, the shims of the prior art are eliminated and solenoid location can be easily established, and if desired, altered in the field.

This invention can be advantageously embodied in a solenoid which includes a housing having a passage extending therethrough, a coil in the housing, a pole piece in the passage of the housing, and an armature mounted in the passage for linear movement along a path toward and away from the pole piece. Resilient means, such as a spring, urges the armature away from the pole piece, and the coil is energizeable to move the armature toward the pole piece. An elongated actuator member is carried by the armature and is movable with the armature between extended and retracted positions.

First adjusting means is provided for adjusting the force which the spring applies to the armature. A separate adjustment feature independent of the spring adjustment is provided to adjust the location of the actuator member relative to the armature.

Although the location of the actuator member can be adjusted in different ways, in one form of the invention, the pole piece is threaded into the passage of the housing, and accordingly, the axial position of the pole piece in the passage of the housing can be adjusted. In the retracted position, the armature engages the pole piece and so by adjusting the axial position of the pole piece, the position of the actuator member in the retracted position is also adjusted.

Preferably, the armature is tubular and the actuator member is mounted on the armature by a tube received in the armature. The actuator member is an elongated thin element which is received in the tube to strengthen the actuator and to permit the use of a larger diameter guide opening in the solenoid housing. In a second form of the invention, the position of the actuator member can be adjusted by utilizing screw threads to mount the tube within the tubular armature.

In a preferred construction, the pole piece has a pole piece passage extending completely therethrough. This provides a number of advantages. For example, the spring can be received in the pole piece passage so that the pole piece can serve as a spring guide. Secondly, the pole piece passage can be used to receive a spring adjustment screw which adjusts the tension on the spring. Finally, in the embodiment where the tube is threaded into the tubular armature, the pole piece passage provides an opening for providing access to the tube so it can be turned and its axial position within the armature adjusted.

The solenoid of this invention also has rapid response. This is accomplished, in part by utilizing dc to energize the coil and by lowering the inductance of the solenoid by utilizing a substantial nonmagnetic gap between the coil and the armature and pole piece. Inductance of the coil is of importance in a dc solenoid during energization of the coil because, during this time, the current lags the voltage in direct proportion to the inductance. This invention reduces the inductance to thereby provide for a more rapid current buildup in the coil. This gives the solenoid a more rapid response. The nonmagnetic gap may be formed by a nonmagnetic solid material and/or a gas, such as air.

This invention also provides for a lower hysteresis by utilizing laminations of low hysteresis magnetic material within the housing and around the core to form at least a portion of the flux path. This also increases the response time and provides for a quicker magnetic dropout which allows the spring to open the valve more quickly.

The invention, together with further features and advantages thereof, may best be understood by reference to the following description taken in connection with the accompanying illustrative drawing.

DESCRIPTION OF THE PREFERRED EMBODIMENTS

Figures 1, 2:
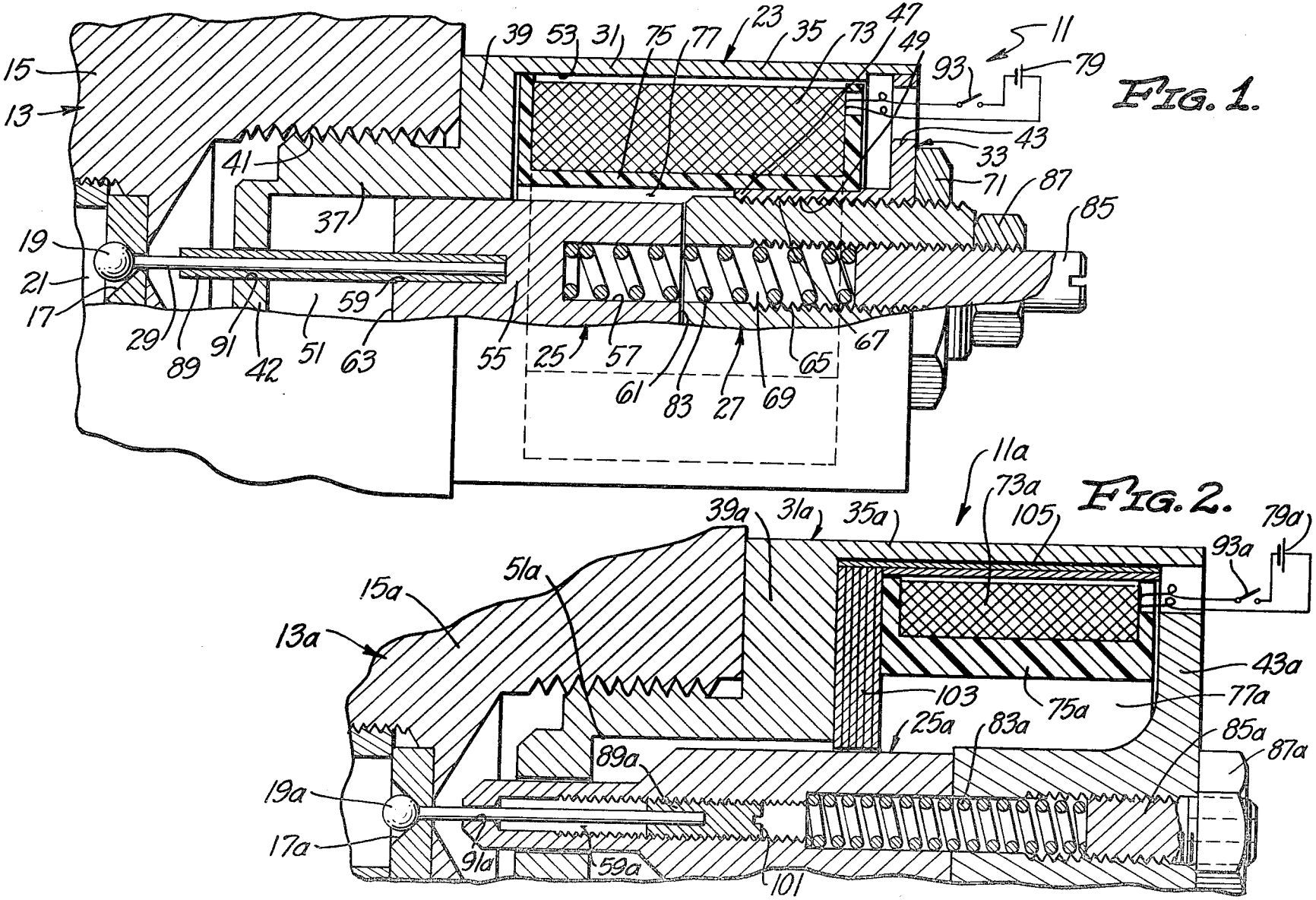
FIG. 1 is an axial sectional view through one form of solenoid constructed in accordance with the teachings of this invention and showing the solenoid being utilized with a valve. A portion of the solenoid is shown in elevation. The solenoid is deenergized and the valve is open.
FIG. 2 is a view similar to FIG. 1 of a second embodiment of the invention with the solenoid energized.

FIG. 1 shows a solenoid 11 mounted on a valve 13. The solenoid 11 can be used to actuate various different devices, and the valve 13 is shown purely by way of example.

The valve 13 generally includes a valve housing 15, a valve seat 17 and a valve element in the form of a ball 19 which is held against the valve seat by fluid under pressure in a passage 21. The solenoid 11 can open the valve by pushing the ball 19 off of the valve seat 17.

The solenoid 11 generally includes a housing 23, an armature 25, a pole piece 27 and an actuator member 29 for cooperating with the ball 19. Although the housing 23 can be of various different constructions, in the embodiment illustrated, it includes a tubular body 31 and a housing section 33, both of which are constructed of magnetic material, such as low carbon steel. The tubular body 31 includes cylindrical peripheral wall sections 35 and 37 integrally joined by a radial wall section 39. The tubular body 31 also has a radial wall section or end wall 42. The cylindrical wall section 37 has external screw threads 41 for attaching the solenoid 11 to the valve housing 15.

The housing section 33 includes an end wall 43 attached to the cylindrical peripheral wall section 35 in any suitable manner, such as by bonding or crimping. The housing section 33 also includes an adjusting sleeve 47 having internal screw threads 49. The housing 23 has an axial passage 51 extending completely through it with a passage enlargement 53 being formed in part by the peripheral wall section 35.

Although the armature 25 can be of different configurations, in the embodiment illustrated, it is tubular and has a web 55 separating a large diameter recess 57 from a small diameter recess 59. The armature has an inner end 61 and an outer end 63. The armature 25 is mounted for movement in the passage 51 by the peripheral wall section 37 which slidably receives the armature. The armature 25 has a retracted position in which the coil 73 is energized and the armature 25 is moved to the right as viewed in FIG. 1 to place the inner end 61 thereof in engagement with the confronting end of the pole piece 27.

The pole piece 27 is in the form of a sleeve having internal screw threads 65 and external screw threads 67. The pole piece 27 has a pole piece passage 69. The pole piece 27 and the armature 25 are constructed of a suitable magnetic material, such as low carbon steel.

The pole piece 27 is mounted in the housing 23 by the external threads 67 and the internal threads 49 of the adjusting sleeve 47. Thus, the axial position of the pole piece 27 in the housing can be adjusted, and once the position is selected, the pole piece can be locked in place by a locking nut 71.

A coil 73 is wound on a bobbin 75, and the bobbin is seated on the adjusting sleeve 47 between the radial wall section 39 and the end wall 43. This leaves an annular air gap 77 between the coil 73 and the armature 25 with a portion of the air gap surrounding the inner end of the pole piece 27. The balance of the pole piece 27 is separated from the coil 73 by a nonmagnetic gap defined by the bobbin 75. The coil 73 is adapted to be energized by a dc source, such as a battery 79, and the coil is coupled to the battery by leads 81 which pass through an opening in the end wall 43. The flux path around the coil 73 includes the body 31, the armature 25, the pole piece 27 and the end wall 43.

A spring 83 is received in and guided by the pole piece passage 69 and the recess 57. One end of the spring 83 bears against the web 55, and the other end of the spring bears against an adjustment screw 85 which is threaded into the outer end of the pole piece passage 69. The spring force exerted against the armature 25 in the retracted position of the armature can be adjusted by turning the adjusting screw 85 within the pole piece passage 69. A lock nut 87 is threaded over the adjusting screw 85 to lock the adjusting screw in the selected position. Both the adjusting screw 85 and the lock nut 87, as well as the lock nut 71, can be constructed of magnetic or nonmagnetic material.

Although the actuator member 29 can be mounted on the armature 25 in different ways, it is preferred to utilize a tube 89 which is received within the recess 59 and which passes through a small diameter opening 91 in the end wall 42. The opening guides the tube 89 and increases its column strength. The tube 89 is preferably constructed of a strong material, such as stainless steel, and it can be magnetic or nonmagnetic. The tube 89 is seated against the outer face of the web 55.

The actuator member 29 in the embodiment illustrated is a small diameter rod or wire, such as music wire, and it can be constructed of magnetic or nonmagnetic material. The actuator member 29 is a cylindrical element of small diameter and it extends completely through the tube 89 and has its inner end seated against the web 55 and its outer end projecting axially outwardly beyond the outer end of the tube 89. In this manner, the actuator member 29 is mounted for linear, axial movement with the armature 25 with the unsupported length of the actuator member being at a minimum.

To set up or calibrate the solenoid 11 in association with the valve 13, the pole piece 27 is retracted or partially withdrawn from the adjusting sleeve 47, and the adjusting screw 85 is loosened so that the spring 83 is relaxed when the armature 25 engages the pole piece 27. The solenoid 11 is then screwed into the valve housing 15 utilizing the threads 41 until the solenoid is firmly and rigidly mounted on the valve housing. With the pole piece 27 and the adjusting screw 85 retracted, the actuator member 29 does not engage the ball 19, and the ball 19 remains firmly seated on the valve seat 17.

Next, the pole piece 27 is turned into the adjusting sleeve 47 until the outer end of the actuator member 29 contacts the ball 19 to move the ball slightly off of the valve seat 17. If the valve 13 is used with a gas, such as air, the air can be heard rushing through the valve so long as the ball is not firmly seated so that opening of the valve is audibly manifest. The pole piece 27 is then retracted in the adjusting sleeve 47 just sufficiently to allow the ball 19 to fully seat on the valve seat 17. Because the coil 73 is deenergized and because the spring 83 is relaxed, the inner end 61 of the armature 25 is in engagement with the pole piece 27 at this time.

The adjusting screw 85 is then advanced into the pole piece 27 the distance required to apply the desired amount of compression on the spring 83. This can be accomplished with the coil 73 energized or deenergized. With the pole piece 27 and the adjusting screw 85 properly positioned, the lock nuts 71 and 87 can be tightened to positively establish the retracted position of the actuator member 29 and the preload on the spring 83.

To open the valve, the current to the coil 73 is interrupted by opening a switch 93 whereupon the spring 83 urges the armature 25 and the actuator member 25 as a unit to the left to move the ball 19 off of the valve seat 17. This is the extended position of the actuator member 29, and it can be established, for example, by a stop (not shown) on the valve 13 which limits the distance which the ball 19 is allowed to travel off of the seat 17. To close the valve 13, the switch 93 is closed to energize the solenoid 11 and move the end 61 against the pole piece 27. It should be noted that the retracted position of the actuator member 29 can be adjusted independently of the means for adjusting the force which the spring 83 exerts on the armature.

FIG. 2 shows a solenoid 11*a* which is identical to the solenoid 11 in all respects not shown or described herein. Portions of the solenoid 11*a* corresponding to portions of the solenoid 11 are designated by corresponding reference numerals followed by the letter "a."

One difference between the solenoids 11 and 11*a* is that the position of the actuator member 29*a* is adjustable by the tube 89*a* which is threaded into the recess 59*a* of the armature 25*a*. The tube 89*a* is shorter than the tube 89, lies entirely within the recess 59*a*, and does not project axially through the opening 91*a*. The actuator member 29*a* is guided and supported by the opening 91*a* through which it passes. The tube 89*a* has an end surface 101 which contains a slot for a screw driver, a socket for a wrench or other suitable means to permit it to be rotated by an appropriate tool which can be inserted through the passage 51*a* when the adjusting screw 85*a* and the spring 83*a* are removed.

With this form of adjusting mechanism for the actuator member 29*a*, the pole piece and the adjusting sleeve are integrally combined to form a pole piece 27*a*. The pole piece 27*a* has the adjusting screw 85*a* threadedly received therein to permit adjusting of the force of the spring 83*a*.

Another noteworthy difference is that the tubular body 31*a* is constructed of nonmagnetic material, such as aluminum, and laminated discs 103 are stacked between one end of the bobbin 75*a* and the radial wall section 39*a*, and laminated cylindrical sleeves 105 are concentrically arranged between the outer periphery of the coil 73*a* and the peripheral wall section 35*a*. Each of the discs 103 may have a radial slot with the slots of the discs 103 being randomly arranged with respect to each other to reduce heat build up. Similarly, each of the sleeves 105 may have an axial slot with the axial slots of the sleeves being randomly arranged for the purpose of reducing heat buildup. The discs 103 and the sleeves 105 are constructed of a low hysteresis magnetic material, such as M6X electrical steel. With this construction, the flux path around the coil is through the discs 103, the sleeves 105, the end wall 43*a*, the pole piece 27*a* and the armature 25*a*. By utilizing low hysteresis magnetic material for the discs 103 and the sleeves 105, magnetic dropout is achieved much more quickly upon deenergization of the coil 73*a*.

Finally, the solenoid 11*a* differs from the solenoid 11 in that the nonmagnetic gap 77*a* includes an air gap which extends for the full axial length of the bobbin 75*a* and the nonmagnetic gap 77*a* is larger than the nonmagnetic gap 77 to provide still lower inductance for the coil. The solenoid 11*a* operates in the same manner as described above for the solenoid 11, and the adjustment of the position of the actuator member 29*a* is also independent of the adjustment for the spring 83*a*.

Although exemplary embodiments of the invention have been shown and described, many changes, modifications and substitutions may be made by one having ordinary skill in the art without necessarily departing from the spirit and scope of this invention.

We claim:

1. A solenoid for moving an external member comprising:

a housing having a passage extending through the housing;

a coil in said housing;

a pole piece in said passage;

an armature;

means for mounting the armature in said passage for linear movement along a path toward and away from the pole piece;

means defining a nonmagnetic gap between the coil and both of said pole piece and said armature;

resilient means for urging the armature in one direction along said path, said coil being energizable to move the armature in opposition to the resilient means in the other direction along said path;

an elongated actuator member for moving the external member;

means for mounting the actuator member on said armature with said actuator member extending beyond said armature whereby the actuator member moves linearly along said path with said armature between an extended position and a retracted position;

first means for adjusting the force which the resilient means applies to the armature to move the armature in said one direction along said path;

second means for adjusting the location of said actuator member along said path whereby the position of the actuator member relative to the external member can be altered; and said armature having a tubular section and said actuator member mounting means including a tube mounted in said tubular section of said armature, said actuator member being received in said tube.

2. A solenoid as defined in claim 1 including a dc source and means for coupling said dc source to said coil whereby said dc source can energize said coil.

3. A solenoid as defined in claim 1 wherein said pole piece has a pole piece passage extending therethrough, said resilient means being received in said pole piece passage and said tubular section of said armature, and said first adjusting means includes a screw threadedly received in said pole piece passage and engaging the resilient means.

4. A solenoid as defined in claim 1 wherein said second adjusting means includes means for mounting said tube in said tubular section of said armature for movement along said path relative to said armature.

5. A solenoid as defined in claim 1 including a plurality of laminations of magnetic material in said housing and including a dc source and means for coupling said dc source to said coil whereby said dc source can energize said coil.

6. A solenoid as defined in claim 5 wherein said laminations are constructed of M6X electrical steel.

7. A solenoid for moving an external member comprising:

a housing having a passage extending through the housing;

a coil in said housing;

a pole piece in said passage;

an armature;

means for mounting the armature in said passage for linear movement along a path toward and away from the pole piece;

means defining a nonmagnetic gap between the coil and both of said pole piece and said armature;

resilient means for urging the armature in one direction along said path, said coil being energizable to move the armature in opposition to the resilient means in the other direction along said path;

an elongated actuator member for moving the external member;

means for mounting the actuator member on said armature with said actuator member extending beyond said armature whereby the actuator member moves linearly along said path with said armature between an extended position and a retracted position;

first means for adjusting the force which the resilient means applies to the armature to move the armature in said one direction along said path;

second means for adjusting the location of said actuator member along said path whereby the position of the actuator member relative to the external member can be altered; and said armature being movable into engagement with said pole piece to define said retracted position and said second adjustable means mounting said pole piece for movement in said housing to establish said retracted position of said actuator member.

8. A solenoid as defined in claim 7 wherein said second adjustable means includes screw threads on said pole piece and said housing for mounting said pole piece for movement on said housing.

9. A solenoid as defined in claim 8 wherein said armature is tubular and said actuator member mounting means includes a tube mounted in said tubular armature, said pole piece being tubular and having a pole piece passage extending therethrough, said resilient means being received in said pole piece passage and said tubular armature to urge said armature away from said pole piece, and said first adjusting means including a screw received in said pole piece passage and screw threads on said screw and said pole piece for adjusting the position of the screw to adjust the force provided by said spring on said armature.

* * * * *